US006467117B1

(12) United States Patent
Lantz et al.

(10) Patent No.: US 6,467,117 B1
(45) Date of Patent: Oct. 22, 2002

(54) LIGHT WEIGHT WORK PLATFORM WITH CRANE

(75) Inventors: Leland L. Lantz, Wayne, PA (US); Dennis W. Colditz, Downingtown, PA (US)

(73) Assignee: General Electric Company, Schenectady, NY (US)

( * ) Notice: Subject to any disclaimer, the term of this patent is extended or adjusted under 35 U.S.C. 154(b) by 16 days.

(21) Appl. No.: 09/660,283

(22) Filed: Sep. 12, 2000

(51) Int. Cl.[7] ..... E01D 6/00

(52) U.S. Cl. ..... 14/6; 14/4; 405/195.1; 414/142.6

(58) Field of Search ..... 14/2.4, 4, 6, 78; 414/142.6, 443, 564; 182/36, 222; 114/221 R, 264, 268; 405/195.1, 201

(56) References Cited

U.S. PATENT DOCUMENTS 1,698,854 A * 1/1929 Nagao ..... 212/333
3,204,780 A * 9/1965 Holt et al. ..... 212/307
3,494,485 A * 2/1970 Hasegawa ..... 414/142.2
3,815,300 A * 6/1974 Bain ..... 52/73
4,170,187 A * 10/1979 Schirtzinger ..... 114/264
4,378,263 A * 3/1983 Logan ..... 156/161
4,676,339 A * 6/1987 Rybka et al. ..... 182/2
4,706,570 A * 11/1987 Moro et al. ..... 105/163.2
5,195,204 A * 3/1993 Muller et al. ..... 14/4
5,388,930 A * 2/1995 McNease ..... 405/209
5,787,137 A 7/1998 Nelson, III
5,794,402 A * 8/1998 Dumlao et al. ..... 52/783.17

* cited by examiner

*Primary Examiner*—Gary S. Hartmann
(74) *Attorney, Agent, or Firm*—Armstrong Teasdale LLP

(57) ABSTRACT

A work platform includes a first elongate side section, a second elongate side section, and a floor section. The first and second side sections each includes a lower beam, an upper beam, and a plurality of support members extending between and coupled to the upper and lower beam. The floor section includes a plurality of cross beams extending between and coupled to the first and second side sections, and a floor panel supported by the cross beams. The work platform also includes a crane assembly movably coupled to the first side section. The crane assembly is longitudinally movable along first side section. The upper beams, lower beams, support members, cross beams, floor panel, and the crane assembly are fabricated from fiber reinforced plastic.

23 Claims, 2 Drawing Sheets

LIGHT WEIGHT WORK PLATFORM WITH CRANE

BACKGROUND OF THE INVENTION

This invention relates generally to work platforms, and more particularly to light weight work platforms fabricated from fiber reinforced plastic components.

Known work platforms that are a bridge or walkway are intended for supporting workers to allow overhead access into deep pools and pits for lowering and manipulating heavy tooling for inspection and work activities. These known work platforms include a plurality of steel and/or aluminum beams and support members coupled together to form a bridge-like structure. The structure includes a floor and two opposing sides of sufficient height to prevent workers from falling from the platform.

Because of the weight of steel and or aluminum, cranes used by workers to lower and manipulate tools in the pits and pools below the work platform needed to be separate from the platform or mounted on the walk space of the floor of the platform.

It is desirable to provide a work platform and crane that are light weight to enable the crane to be positioned so as not to impede floor space work area on the work platform. Further it is desirable to provide a work platform and crane that is less expensive than the known work platforms and associated cranes.

BRIEF SUMMARY OF THE INVENTION

In an exemplary embodiment, a work platform is a bridge-like structure that includes a first elongate side section, a second elongate side section, and a floor section. The first and second side sections each includes a lower beam, an upper beam, and a plurality of support members extending between and coupled to the upper and lower beam. The floor section includes a plurality of cross beams extending between and coupled to the first and second side sections, and a floor panel supported by the cross beams. The upper beam, lower beam, support members, cross beams, and floor panel are fabricated from fiber reinforced plastic.

The work platform also includes a crane assembly movably coupled to the first side section. The crane assembly is longitudinally movable along the first side section. The crane includes a vertical beam and a horizontal boom extending substantially perpendicularly from an upper end portion of the vertical beam. The crane vertical beam and the crane boom are fabricated from fiber reinforced plastic. The crane further includes a lifting cable operatively coupled to a motor which is coupled to the crane vertical beam. The motor acts as a counter weight for a load attached to the lifting cable.

The above described work platform and crane is light weight and cost effective. Additionally, the configuration of the crane provides for one side section hand rail and the floor space to be completely free of obstructions.

DETAILED DESCRIPTION OF THE INVENTION

Figure 1:
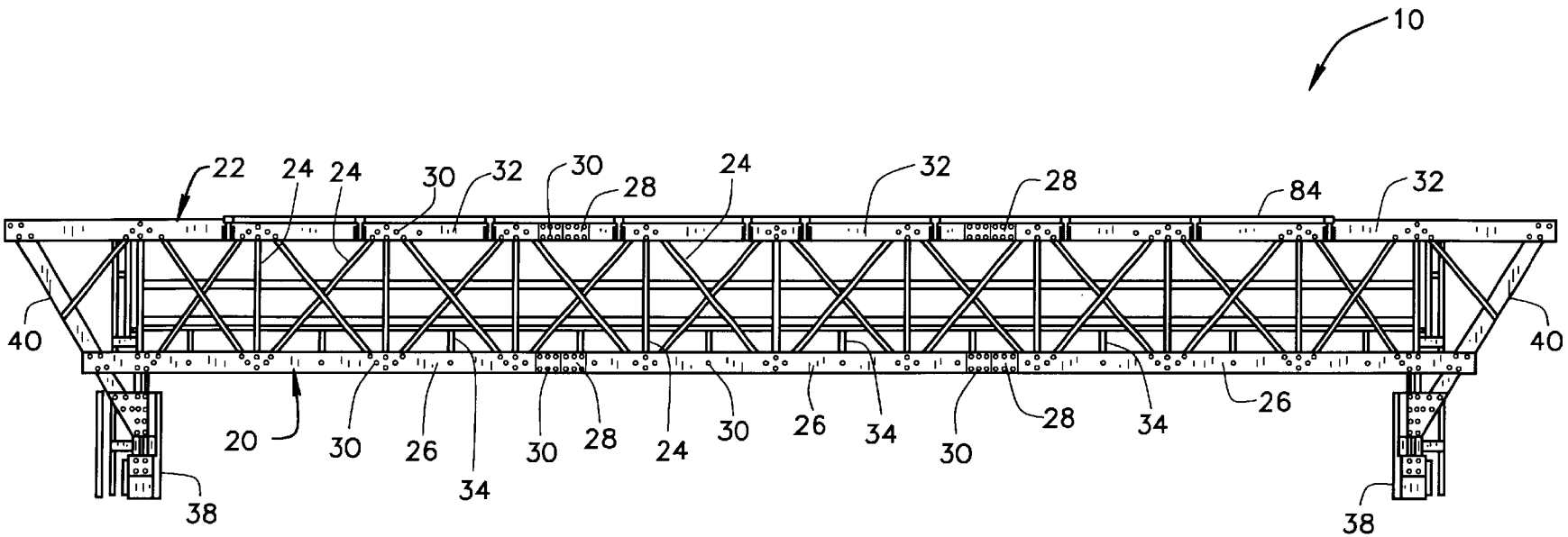
FIG. 1 is a side view of a light weight work platform in accordance with an embodiment of the present invention.
Figure 2:
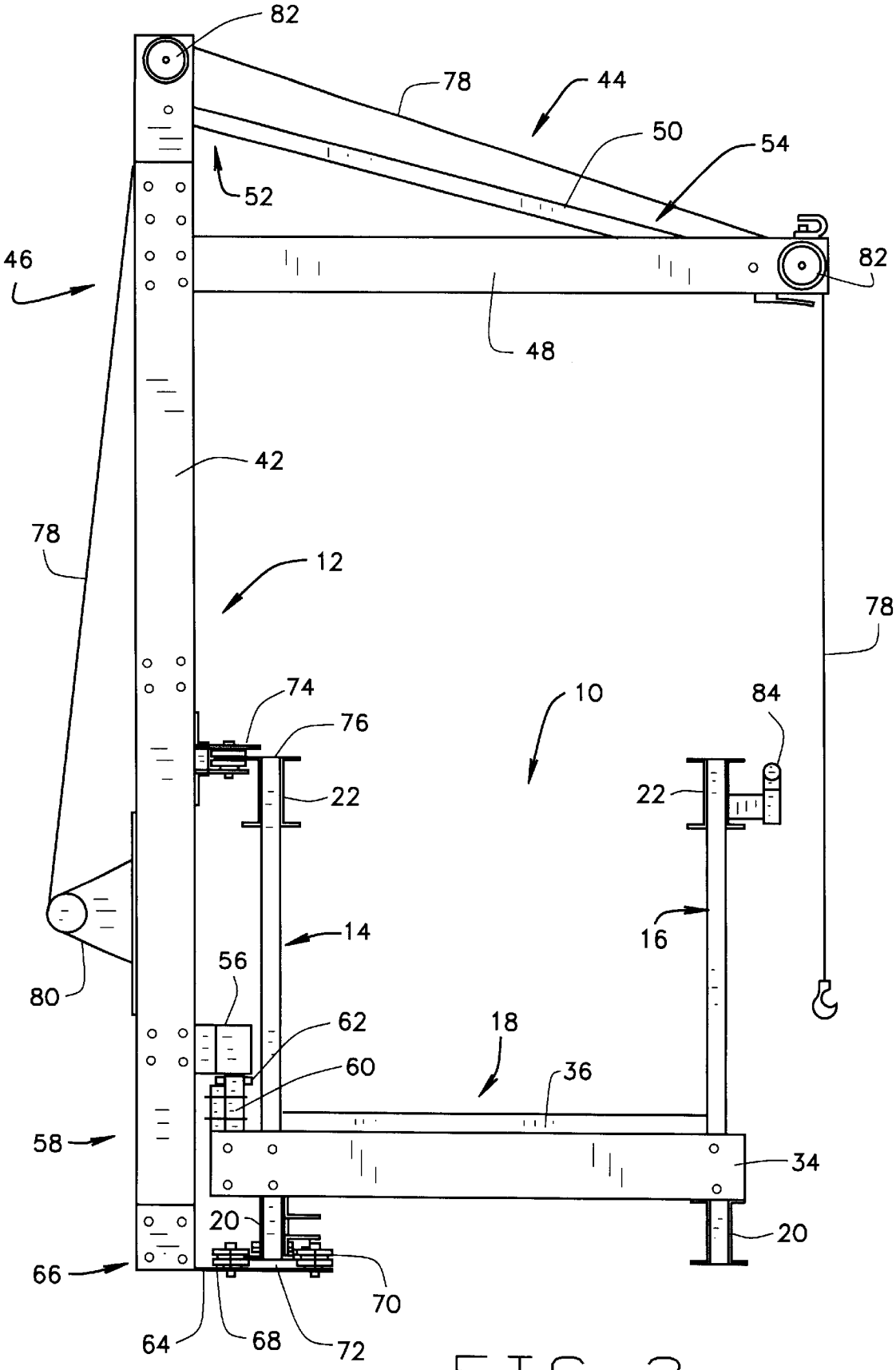
FIG. 2 is an end view of the work platform shown in FIG. 1 with an attached crane.

FIG. 1 is a side view of a light weight work platform 10 in accordance with an embodiment of the present invention, and FIG. 2 is an end view of work platform 10 with a crane 12 attached. Referring to FIGS. 1 and 2, work platform 10 is a bridge like structure that includes a first side 14 section, a second side section 16, and a floor section 18.

First and second side sections 14 and 16 include a lower beam 20, an upper beam 22, and a plurality of support members 24 extending between and coupled to lower and upper beams 20 and 22. Lower beam 20 is formed from a plurality of lower beam sections 26 that are positioned end-to-end and coupled together by splice plates 28 and fasteners 30. Of course, other beam splicing techniques can be used. Similarly, upper beam 22 is formed from a plurality of upper beam sections 32 positioned end-to-end and coupled together by splice plates 28 and fasteners 30.

Floor section 18 includes a plurality of cross beams 34 extending between and coupled to first and second side sections 14 and 16. Floor section 18 also includes a floor panel 36 extending the length of platform 10 and supported by cross beams 34. Floor panel 36 also extends between first side section 14 to second side section 16. Floor panel 36 can be a solid panel or an open grid panel or grate. In an alternate embodiment, floor panel 36 is formed from a plurality of floor panel sections (not shown).

A plurality of support feet 38 (two shown) extend from the bottom of platform 10. Support feet 38 elevate platform 10 over obstructions surrounding the pits or pools that platform 10 is positioned over, for example pool ladders, pit ladders, and piping. To provide lateral support, feet support beams 40 extend diagonally from upper beam 22 to support feet 38. Support beams 40 are coupled to upper beam 22 and lower beam 20.

Crane 12 includes an elongate vertical beam 42 and a boom 44 extending substantially perpendicularly from an upper end portion 46 of vertical beam 42. Boom 44 includes a horizontal beam 48 extending substantially perpendicularly from, and coupled to upper end portion 46 of vertical beam 42. A boom support beam 50 extends at an angle from vertical beam 42 and a first end 52 of beam 50 is coupled to upper end portion 46 of vertical beam 42 and a second end 54 of beam 50 is coupled to horizontal beam 48.

A trolley 56 is attached to a lower end portion 58 of vertical beam 42. Trolley 56 rides on a trolley support beam 60 coupled to platform 10. Support beam 60 is coupled to cross beams 34 and is spaced apart from and substantially parallel to lower beam 20 of first side section 14. Trolley 56 also includes retaining guide rollers 62 positioned to engage opposing sides of trolley support beam 60. A bottom plate 64 is coupled to a lower end 66 of vertical beam 42 and extends toward lower beam 20 of first side section 14. A plurality of inside guide rollers 68 (one shown) and a plurality of outside guide rollers 70 (one shown) are coupled to bottom plate 64 and are positioned so that guide rollers 68 and 70 engage opposite sides of a lower flange 72 of lower beam 20 of first side section 14. An upper guide wheel 74 is coupled to crane vertical beam 42 at a position so that guide wheel 74 engages an upper flange 76 of upper beam 22 of first side section 14.

Crane 12 further includes a lifting cable 78 operatively coupled to a motor 80. Motor 80 is mounted on crane vertical beam 42 Cable guide rollers 82 are coupled to vertical beam 42 and boom horizontal beam 48. To ensure that second side section 16 does not interfere with the movement of lifting cable 78, crane boom 44 extends from vertical beam 42 so that second end 54 of boom horizontal beam 48 extends beyond second side section 16.

Crane 12 is movable longitudinally along work platform 10. Particularly, crane 12 is supported by trolley support beam 60 and moves along beam 60. Retaining guide rollers 62 prevent crane 12 from running off support beam 60. Inside and outside guide rollers 68 and 70 and upper guide wheel 74 prevent rotation of crane 12 and aide in maintaining crane 12 in an upright orientation.

The main components of light weight work platform 10 and crane 12 including upper and lower beams 20 and 22, support members 24, cross beams 34, floor panel 36, support feet 38, support beams 40, crane vertical beam 42, boom horizontal beam 48 boom support beam 50, trolley 56, and trolley support beam 58 are fabricated from fiber reinforced plastic. Any suitable fiber reinforced plastic can be used to fabricate the above described components, for example fiberglass reinforced plastic, carbon fiber reinforced plastic, aramid fiber (aromatic polyamid fibers) reinforced plastic, and combinations thereof. The fibers can be unidirectional, chopped, or woven. The plastic can be formed from any suitable resin. Suitable resins include, but are not limited to, thermosetting resins, for example, vinyl ester resins, epoxy resins, and unsaturated polyester resins.

The above described work platform 10 and crane 12 is light weight and cost effective. Additionally, the configuration of crane 12 provides for a second side section 16 hand rail 84 and floor panel 36 to be completely free of obstructions.

While the invention has been described in terms of various specific embodiments, those skilled in the art will recognize that the invention can be practiced with modification within the spirit and scope of the claims.

What is claimed is:

1. A work platform comprising:

a first elongate side section;

a second elongate side section, said first and second side sections each comprising a lower beam, an upper beam, and a plurality of support members extending between and coupled to said upper and lower beam;

a floor section comprising a plurality of cross beams extending between and coupled to said first and second side sections, and a floor panel supported by said cross beams, said upper beam, said lower beam, said support members, said cross beams, and said floor panel comprising fiber reinforced plastic; and a crane assembly movably coupled to said first side section, said crane assembly longitudinally movable along said first side section.

2. A work platform in accordance with claim 1 wherein at least one of said upper and lower beams of said first and second side sections comprise a plurality of beam members coupled together to form a single beam.

3. A work platform in accordance with claim 1 wherein said crane comprises a vertical beam and a horizontal boom extending substantially perpendicularly from an upper end portion of said vertical beam, said crane vertical beam and said crane boom comprising fiber reinforced plastic.

4. A work platform in accordance with claim 3 wherein said boom comprises a horizontal beam coupled to an upper end portion of said crane vertical beam and a boom support member extending at an angle from said crane vertical beam and coupled to said boom horizontal beam and said crane vertical beam.

5. A work platform in accordance with claim 3 wherein said crane further comprises upper and lower guide rollers coupled to said crane vertical beam, said upper guide rollers engaging said first side upper beam, and said lower guide rollers engaging said first side lower beam.

6. A work platform in accordance with claim 3 wherein said crane further comprises a trolley attached to a lower portion of said crane vertical beam, and said first side section further comprising a trolley support beam extending longitudinally and spaced apart from said first side portion lower beam, said trolley support beam and said first side portion lower beam being substantially parallel, said trolley movable along and supported by said trolley support beam.

7. A work platform in accordance with claim 3 wherein said crane further comprising a lifting cable operatively coupled to a motor, said motor coupled to said crane vertical beam, said motor providing a counterweight for a lifted load.

8. A work platform in accordance with claim 7 wherein said crane further comprises a plurality of cable guide rollers.

9. A work platform in accordance with claim 7 wherein said crane boom extends past said second side section so that said second side section does not interfere with the vertical motion of said lifting cable.

10. A work platform in accordance with claim 1 further comprising a plurality of support feet.

11. A work platform in accordance with claim 10 wherein each said support foot comprises a roller located at a lower end of said support foot and configured to engage at least one of a rail and a plant floor.

12. A light weight work platform comprising:

a first elongate side section comprising a plurality of beams and a plurality of support members extending between said plurality of beams;

a second elongate side section comprising a plurality of beams and a plurality of support members extending between said plurality of beams;

a floor section comprising a plurality of cross beams extending between and coupled to said first and second side sections, said beams, said support members, and said cross beams comprising fiber reinforced plastic; and a crane assembly movably coupled to said first side section, said crane assembly longitudinally movable along said first side section.

13. A light weight work platform in accordance with claim 12 wherein said first side section comprises a lower beam and an upper beam and a plurality of support members extending between and coupled to said upper and lower beams, and said second side section comprises a lower beam and an upper beam and a plurality of support members extending between and coupled to said upper and lower beams.

14. A light weight work platform in accordance with claim 13 wherein at least one of said upper and lower beams of said first and second side sections comprise a plurality of beam members coupled together to form a single beam.

15. A work platform in accordance with claim 13 wherein said crane comprises a vertical beam and a horizontal boom extending substantially perpendicularly from an upper end portion of said vertical beam, said crane vertical beam and said crane boom comprising fiber reinforced plastic.

16. A work platform in accordance with claim 15 wherein said boom comprises a horizontal beam coupled to an upper end portion of said crane vertical beam and a boom support member extending at an angle from said crane vertical beam and coupled to said boom horizontal beam and said crane vertical beam.

17. A work platform in accordance with claim 15 wherein said crane further comprising a lifting cable operatively coupled to a motor, said motor coupled to said crane vertical beam.

18. A work platform in accordance with claim 17 wherein said crane further comprises a plurality of cable guide rollers.

19. A work platform in accordance with claim 17 wherein said crane boom extends past said second side section so that said second side section does not interfere with the vertical motion of said lifting cable.

20. A work platform in accordance with claim 15 wherein said crane further comprises a trolley attached to a lower portion of said crane vertical beam, and said first side section further comprising a trolley support beam extending longitudinally and spaced apart from said first side portion lower beam, said trolley support beam and said first side portion lower beam being substantially parallel, said trolley movable along and supported by said trolley support beam.

21. A work platform in accordance with claim 15 wherein said crane further comprises upper and lower guide rollers coupled to said crane vertical beam, said upper guide rollers engaging said first side upper beam, and said lower guide rollers engaging said first side lower beam.

22. A light weight work platform in accordance with claim 12 further comprising a plurality of support feet.

23. A work platform in accordance with claim 22 wherein each said support foot comprises a roller located at a lower end of said support foot and configured to engage at least one of a rail and a plant floor.

* * * * *